United States Patent [19]

Grimm

[11] Patent Number: 4,932,199

[45] Date of Patent: Jun. 12, 1990

[54] OPEN-END SPINNING DEVICE

[75] Inventor: Eberhard Grimm, Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 387,344

[22] Filed: Jul. 28, 1989

[30] Foreign Application Priority Data

Aug. 2, 1988 [DE], Fed. Rep. of Germany ..... 3826117

[51] Int. Cl.[5] ..... D01H 4/12

[52] U.S. Cl. ..... 57/88; 57/404; 57/406

[58] Field of Search ..... 57/88, 406, 89, 404, 57/407

[56] References Cited

U.S. PATENT DOCUMENTS

| | | | |
|---|---|---|---|
| 4,112,659 | 9/1978 | Stahlecker et al. | 57/88 X |
| 4,158,284 | 6/1979 | Wehde | 57/404 X |
| 4,380,143 | 4/1983 | Abdugarier et al. | 57/88 X |
| 4,653,265 | 3/1987 | Stahlecker et al. | 57/406 X |

*Primary Examiner*—Stuart S. Levy
*Assistant Examiner*—Steven M. duBois
*Attorney, Agent, or Firm*—Dority & Manning

[57] ABSTRACT

The instant invention relates to an open-end spinning device in which the spinning rotor is mounted on the drive shaft. The bearing and braking means are designed so that the spinning rotor can also be operated and braked securely at high rotational speeds. This is achieved by installing the braking means between the open end of the spinning rotor and the rotor shaft bearing system.

20 Claims, 4 Drawing Sheets

FIG. 1
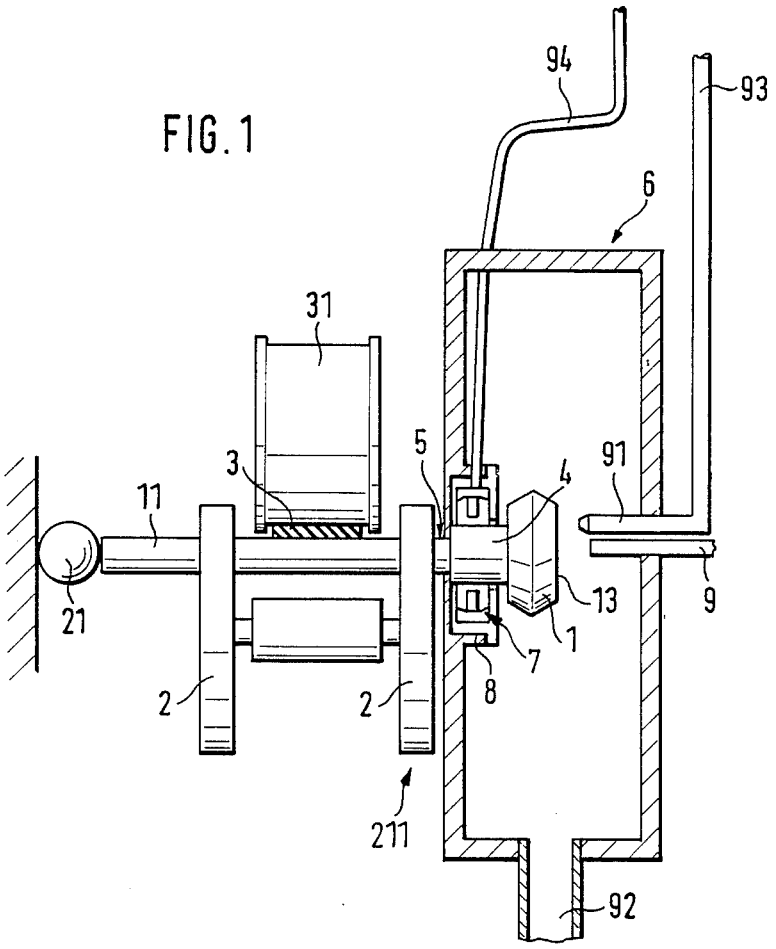
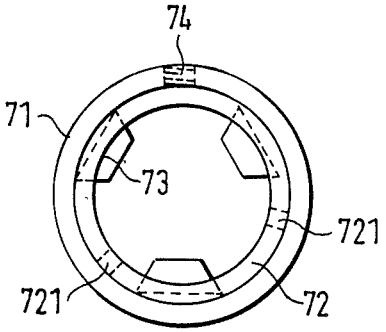
FIG. 2

OPEN-END SPINNING DEVICE

OPEN-END SPINNING DEVICE

Background of the Invention

The instant invention relates to an open-end spinning device with a spinning rotor rotating in a rotor housing and having a collection groove to receive the fibers to be spun. The rotor is mounted on a free end of the shaft and is supported by the shaft in the open-end spinning device, and with braking means to stop the spinning rotor.

In open-end spinning devices with a rotating spinning rotor two different bearing principles are in general use. One is the principle of direct bearing support, shown for example in German Patent No. 2,405,499, and another is the principle of coil-cradle bearing, shown for example, in the German AS No. 2,162,646. This should also include a combination of the two principles as shown in the German OS No. 3,346,843.

To achieve greater economy in the spinning process, higher production speeds are desired. For this it is necessary to increase the rotational speed of the rotor. A higher rotor speed, for example, of over 100,000 rpm's, requires high standards for the design and bearing of the spinning rotor since the oscillating attitude, and the critical speed of the spinning rotor must be influenced favorably by structural measures.

In the known open-end spinning device the spinning rotor has a shaft which goes through the rotor housing and is supported by the shaft. Similarly, drive and braking means act on the rotor through the shaft. The conventional arrangement of rotor housing, support and braking means make it necessary for the shaft to be relatively long, and this is not good from the point of view of oscillation.

In another open-end spinning device which is shown in the German OS No. 3,533,717, the brake is located between the supporting disks, below the belt. In this design, it is not possible to fix the rotor shaft during braking and when it is stopped by means of the braking means. The space into which the brake is built in is, furthermore, very narrow. In the German OS No. 2,708,936 rotor brakes in the form of eddy current brakes are shown. These have the disadvantage that braking of the rotor is not rapid and secure enough. Fixing the rotor in the braked state is not possible to a sufficient degree with these brakes.

There are limits to the design possibilities of the known open-end spinning rotor, since a spinning rotor running in a housing, which is subjected to negative pressure must have precise support and appropriate braking and drive means.

Summary of the Invention

It is the object of the invention to provide an arrangement of support and braking means, which makes it possible to influence the oscillations and critical speeds of the spinning rotor through a simple design.

It is a further object of the invention to brake the spinning rotor securely and rapidly at high speeds, and in particular to fix it in the braked state when a coil cradle bearing is used.

The objects are attained one embodiment of the invention in that the braking means is made in the form of a mechanical friction brake and is located in the rotor housing. By using a braking means which exerts a braking effect on the spinning rotor through mechanical friction, rapid and secure braking is possible even at high rotor speeds. With brakes of this design it is also possible to fix the rotor in the braked condition, also where coil cradle bearings are used. By placing the braking means in the rotor housing, it is possible with a coil cradle bearing or with a combination of both bearing types, to reduce the distance between the two support locations for the spinning rotor. Furthermore, the overhang of the rotor beyond the pair of supporting disks facing the rotor can be reduced. This reduces the oscillation of the spinning rotor at high speeds.

A further advantage with both types of support is that braking is applied near the greatest mass of the spinning rotor, so that the oscillation during braking is influenced advantageously.

A further advantage is the fact that the braking means are easily accessible. This facilitates control and replacement of the braking means without the impairment of the other spinning stations of the machine so that it is not necessary to interrupt the spinning process at these stations. It is a further advantage that the braking means are installed separately from the bearing support so that the bearing support cannot be soiled by dust from the braking. By applying suction to the rotor housing, the braking dust is sucked off at the same time so that neither bearing support nor yarn are impaired by braking dust.

In a further embodiment of the invention the rotor housing is designed so that it extends as far as the pair of supporting disks facing the spinning rotor. This makes it possible for the entire area between the open end of the spinning rotor and the foremost pair of supporting disks to be available for the installation of the braking means, so that the rotor overhang can be kept very short.

In a still further embodiment of the invention the braking means are subjected to a flow of air for the purpose of cooling and for the removal of the braking dust.

In yet another embodiment, the braking means are insulated from their surroundings. This ensures that the braking dust cannot settle on other parts of the machine in an undesirable manner and affect them negatively.

A hub to which the braking means can be applied is especially advantageous for braking the spinning rotor when it is provided on the shaft. By braking against a wide diameter than that of the rotor shaft, the temperatures developed during braking are lower.

In a further embodiment of the invention the braking means are to be applied to the spinning rotor. This has the advantage that braking is applied in the area of greatest momentum and that the spinning rotor can be kept especially stable during braking.

BRIEF DESCRIPTION OF THE DRAWINGS

Embodiments of the instant invention are described and explained in the description of the drawings in which:

FIG. 1 shows the spinning device of the invention in a sectional view;

FIG. 2 shows a collar brake with three brake shoes in a top view;

Detailed Description of the Invention

Figure 3:
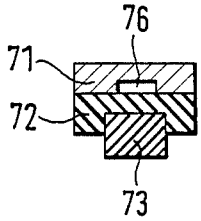
FIG. 3 shows a section through the collar brake of FIG. 2.

Fig. 1 shows a spinning rotor 1 which is supported with its shaft 11 in a nip constituted by pairs of supporting disks 2. The spinning rotor 1 is driven by its shaft 11 by means of a tangential belt 3 in combination with a pressure roller 31. Other drive types, in particular drives with a driving roller, are also possible. The axial forces applied, in a known manner, to the spinning rotor 1 are absorbed at its end by a ball 21. Rotor 1, with its open end 13, and with the hub 4, extends into the rotor housing 6. Housing 6 is subjected to negative pressure by means of suction line 92. Air is supplied by the fiber feeding channel 9 or by the cleaning nozzle 91. The distance between the pairs of supporting disks 2, is shown correspondingly smaller than in the known devices with braking means installed between the pairs of supporting disks 2.

The braking means 7 are placed inside the rotor housing. The distance between the supporting disks is thereby smaller than that found in a conventional arrangement of the braking means between the supporting disks. The overhang of the spinning rotor is especially short due to the effect of the brake 7 on the hub 4. The shaft 11, which is located between the forward pair of supporting disks 211 and the hub 4, and the spinning rotor 1 need to be only sufficiently long so that the sealing means to seal rotor housing can be installed.

Fig. 2 shows the brake installed in the rotor housing 6 in accordance with the invention as seen in FIG. 1. In its preferred embodiment, it is a pneumatically controlled, centrically braking collar brake 7 and is preferably installed in the rotor housing 6 by means of a press fit 8 (FIG. 1). On the inside of a carrier ring 71 is a rubber-like lining, braking collar 72. Into collar 72 the brake shoes 73 are imbedded, for example, vulcanized into the mass, and protrude form the brake collar 72 in the direction of the longitudinal axis of the ring 71. Holding devices and guides for the brake shoes are thereby rendered unnecessary, and problems with soiled guides are thus avoided. By deforming the brake collar 72, the brake shoes 73 are advanced to the part with which they interact. To achieve deformation, a medium, preferably air, is injected into an interval 76 extending over the entire circumference between the braking sleeve 72 and the carrier ring 71. This creates a ring-shaped swelling which propagates itself in direction of the central longitudinal axis of the ring. The inside diameter of the collar brake 7 is thereby reduced and the brake shoes 73 are thus advanced to the part to be braked. The medium is injected into the interval 76 through an air intake bore 74 in the carrier ring 71. A liquid, such as oil can also be used as the medium.

In an embodiment (not shown here) of such a brake the brake shoes, which are supported in guides, are advanced by means of a hose-shaped ring channel made of a rubber-like material capable of being deformed. When the ring channel widens it bears with its outer circumference against the wall of the chamber into which it is built.

FIG. 3 shows the interval, in form of a groove 76, between carrier ring 71 and braking sleeve 72 and a brake shoe 73 embedded in sleeve 72.

Figure 4:
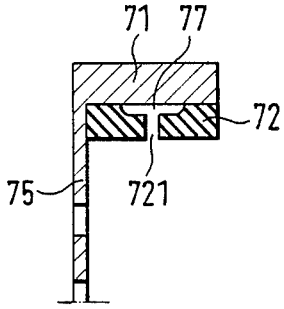
FIG. 4 shows a further embodiment of the collar brake in a sectional view.

FIG. 4 shows an embodiment of the collar brake 7 with a rim 75 through which attachment is possible, e.g. by means of screws. The groove 76 of FIG. 3 is replaced in this embodiment by a ring-shaped gap 77. The latter is constituted through the fact that the braking sleeve 72 and the carrier ring 71 are not connected to each other in this zone.

FIG. 2 furthermore shows an advantageous arrangement of the brake shoes 73 which are distributed at the same distance between each other over the circumference. Concentric braking is made possible if more than two brake shoes 73, preferably three, are evenly distributed over the circumference. It is also possible to fix the spinning rotor 1 in a stopped position in this way.

In FIG. 1, the rotor housing 6 is installed directly after the nearest pair of supporting disks 211. The brake, in the form of a collar brake 7, interacts in accordance with the invention with a hub 4 installed on the shaft 11. However, it is also possible, for example, to let the collar brake 7 act upon the spinning rotor 1. FIG. 1 shows the connecting line 94 connected to the pneumatic supply line 93 through which pneumatic rotor cleaning is supplied. Air is supplied by the supply line 93 to the cleaning nozzle 91. The braking and cleaning devices are coupled to each other via same. When the spinning rotor has stopped, cleaning air continues to flow into the spinning rotor 1 which is thereby able to transmit built-up braking heat to the environment. At the same time suction from line 92 continues to operate in order to apply suction to the brake drive.

Figure 5:
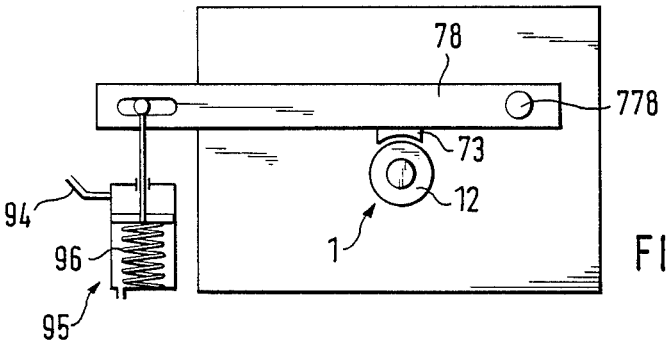
FIG. 5 shows a brake actuated by means of lever and compressed air.

The embodiment of FIG. 5 shows a brake actuated by means of a lever. The illustration is a top view of the spinning rotor 1 which extends into a rotor housing 6. Above it, a brake lever 78 is pivotably supported on a bolt 778 so that the brake shoes 73 can be applied to the rotor plate 12. This is done by a compressed air cylinder 95 with reset spring 96, which is connected by means of a connecting line 94 to the supply line 93 of the compressed-air rotor cleaning and is connected to it for control. The actuating mechanisms of the brake of FIG. 5 as well as of FIG. 6 can be located inside the rotor housing as well as outside it. In the latter case, the location at which the lever penetrates is sealed so that the negative pressure can be maintained within the rotor housing.

Figure 6:
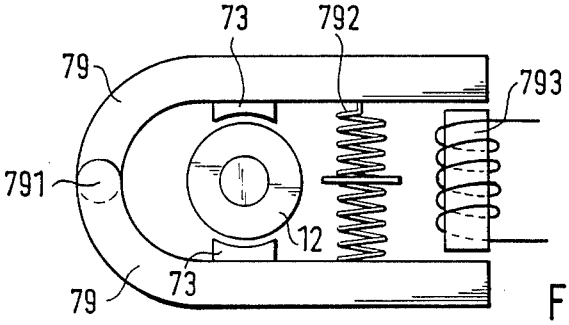
FIG. 6 shows a brake actuated electromagnetically through a lever.

FIG. 6 shows an electromagnetically actuated brake with two levers 79 which are rotatably attached at a common point 791. The brake is held open by a spring 792. To brake, both lever ends 79 are pulled together by an intermittently acting solenoid 793 and the brake shoes 73 are applied to the rotor plate 12. When they are applied to the rotor plate 12 as shown here, the brake shoes 73 are provided with a V-shaped groove which is derived from the form of the rotor plate 12 at its outer circumference in such a manner that the spinning rotor 1 can be both guided and held axially during braking.

FIG. 4 and FIG. 2 show the bores 721 for the cooling of the braking surface by means of compressed air. The bores 721 go through the braking collar 72 into the gap 77 or, in another embodiment of the collar brake 72, into the groove. The same air which is also used to expand the braking collar 72 during braking action is also used for cooling. Groove 76 or gap 77 must be designed to take the air losses of the bore or bores 721 into account, so that sufficient pressure is still available to deform the braking collar 72. The bores 721 can be made so that the emerging air brushes over the cooling surface radially to tangentially.

Figure 7:
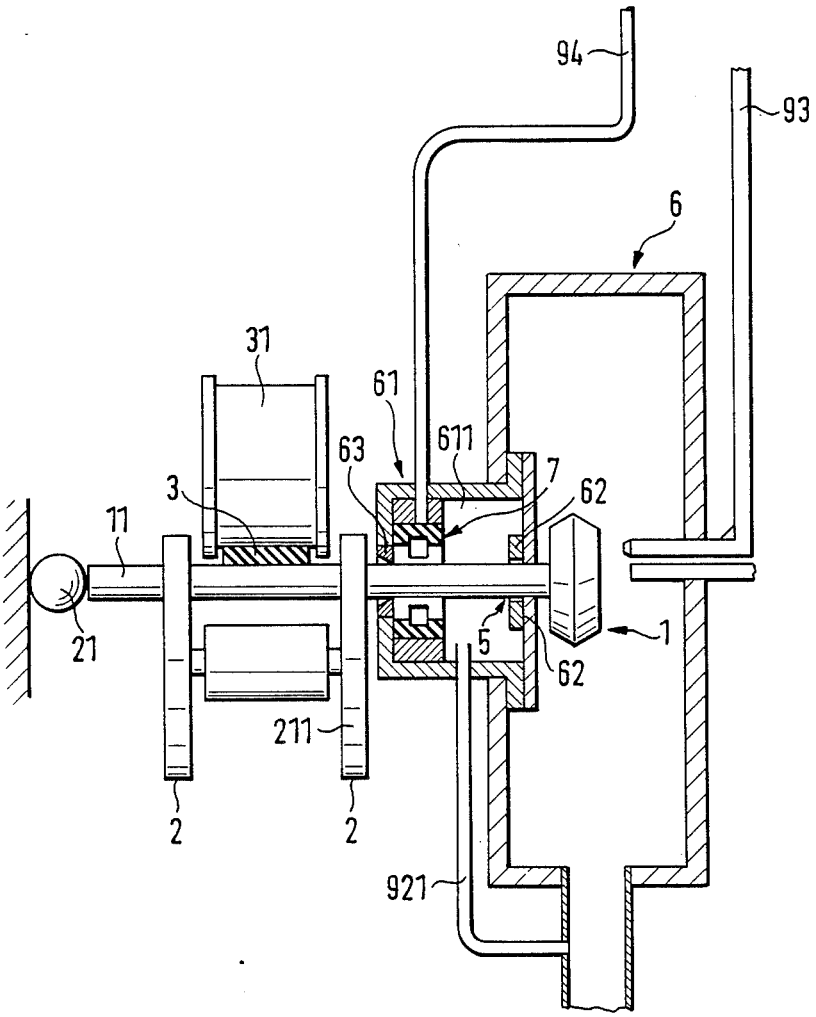
FIG. 7 shows a spinning device according to the invention with separate spaces for the braking and spinning means.

FIG. 7 shows a part of a spinning device with separate chambers for spinning means which are essentially rotor plates 12 and cleaning nozzle 91 (FIG. 1), and the braking means, e.g. the collar brake 7 (FIG. 1). The housing 61 of the braking means is mounted on the rotor housing 6 by means of mounting means which are not shown here. In order to achieve clarity, the distance between the rotor plate 12 and the nearest supporting disk 21 is considerably enlarged in the drawing. The opening 5 of the rotor housing 6 for the shaft 11 of the spinning rotor 1 is sealed by means of a sealing disk 62 so that no dust abraded by braking may enter into the rotor housing 6. A negative pressure line 921 through which the dust abraded by braking and the cooling air, when the shaft 11 is air-cooled, is removed, extends into the braking means chamber 611. The cooling of shaft 1 is effected by the air emerging from the braking collar 72 through bore 721 in the embodiment shown in FIGS. 2 and 4. For this purpose an extra cooling line to supply the cooling air can also be provided. In that case, the location of shaft 1 or hub 4 which interacts with the braking means 7 is blown upon and cooled. The removal of the braking dust then takes place through the negative pressure line 291. The braking means chamber 611 is sealed off by means of a sealing unit 63 acting on one side only, so that air can be sucked into the braking means chamber 611 but can leave it only through negative pressure line 921. The collar brake 7 interacts with the shaft 11 and is supplied with compressed air by the connecting line 94 going to the supply line 93. The collar brake 7 is attached in the brake means housing 61 by means of a clamping mechanism (not shown). To remove the collar brake 7, the entire brake means housing 61 can be removed, if necessary, without disassembling the rotor housing 6, with only the spinning station concerned having to be stopped.

With the possibility of braking the spinning rotor 1 directly, as shown in FIGS. 5 and 6, whereby this can also be effected by a concentric braking collar brake 7, the spinning rotor 1 can be cooled by an air stream cooling the outer circumference 12 of the spinning rotor 1 as well as by an airstream cooling the interior of said spinning rotor 1. In the latter case, the cleaning nozzle 91 can be used for the spinning rotor 1. Pneumatic rotor cleaning is already started during braking and is used for cooling before the cleaning process. This can be effected by a common control, for example. However, it is also possible to provide special nozzles to cool the rotor on its outer circumference. The removal of braking dust can be effected by a suction line 92 of the rotor housing 6.

Figure 8:
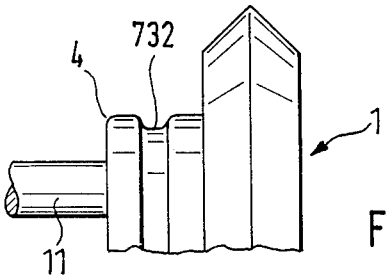
Fig. 8 shows a hub with a groove.
Figure 10:
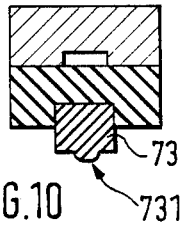
Figs. 10 and 11 show brake shoes in profile.

FIG. 8 shows a spinning rotor with hub 4 and shaft 11. The hub 4 changes in diameter over its circumference. This change is represented in form of a trough-shaped groove 732 in FIG. 8. A change in diameter can also be understood to be a sudden change of the diameter for example, as at the juncture of shaft and hub. In that case it is, however, necessary for axial guidance that the smaller diameter be located on the side away from the free end of the shaft, and that a second axial guide, e.g. ball 21, be provided. A profiled brake shoe 73, as shown in FIG. 10, interacts with the groove 732 of FIG. 8. The brake shoe 73 brakes over its entire side facing the hub 4, so that wear is even and the profile 731 is maintained. Soft transitions ensure that the spinning rotor 1 can be disassembled even when the brake is adjusted with little air. The trough-shaped configuration of the groove 732 and the elasticity of the brake collar 72 ensures this. When braking, the combined action of the profile 731 and the change of diameter causes the spinning rotor to be held securely in the axial sense. Such a change in diameter can for instance be also a reduction of the diameter which is not compensated again by a second change in diameter, as in the case of a groove. In such an instance, axial guidance can also be achieved, although only one-sidedly. This would be sufficient, for example, in the bearing design shown in FIG. 1, since the spinning rotor 1 would be held axially on the one hand, by ball 21, and on the other hand by the brake. The hub 4 can be a part slipped over the shaft 11, can be part of the shaft 11 or can be part of the spinning rotor.

Figure 9:
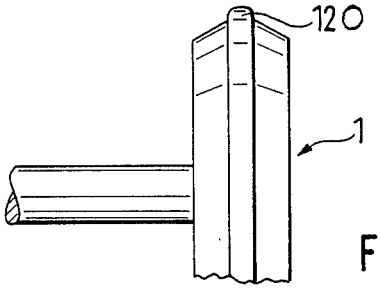
Fig. 9 shows a spinning rotor with a collar.
Figure 11:
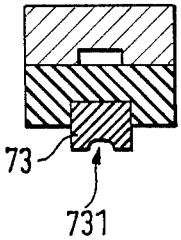

FIG. 9 shows a spinning rotor provided with a collar 120 at its widest diameter, with which the brake shoes 73 interact guidingly in an axial direction. FIG. 11 shows a corresponding brake shoe 73 with a groove-shaped profile. Corresponding diameter changes, in the form of a groove or of a collar for example, can be provided according to the invention on the hub 4 and on the spinning rotor 1 as well as on the shaft 11.

Just as for spinning devices with indirect bearing support, as in the description of the invention in this case, the invention can also be used with direct bearing support according to the instant invention. The instant invention can also be applied to advantage with indirect bearing support where the axial guidance of the shaft is effected by the bearing and driving disks interacting with said shaft.

I claim:

1. An open-end spinning device, comprising:
(a) an open-end spinning rotor housing;
(b) an open-end spinning rotor disposed within said rotor housing;
(c) a support shaft extending through a wall of said rotor housing and having one end supporting said open-end spinning rotor;
(d) spaced bearing means disposed outside of said rotor housing for supporting said support shaft for rotation;
(e) drive means for driving said support shaft outside of said rotor housing; and
(f) braking means disposed within said housing between said rotor and said wall of said housing for applying braking force upon a surface for stopping said rotor and said support shaft.

2. An open-end spinning device as set forth in claim 1, wherein means are provided for creating a negative pressure in said rotor housing.

3. An open-end spinning device as set forth in claim 1, wherein means are provided for directing a flow of air over said braking means for cooling said braking means and for removing dust therefrom.

4. An open-end spinning device as set forth in claim 1, wherein means are provided for insulating said braking means from said rotor.

5. An open-end spinning device as set forth in claim 1, wherein said rotor is provided with a hub which extends about said support shaft and is attached to said rotor, having a surface disposed for braking contact with said braking means.

6. An open-end spinning device as set forth in claim 1, wherein said braking means are disposed to apply braking force directly upon said rotor.

7. An open-end spinning device as set forth in claim 1, wherein said braking means are disposed concentrically about the longitudinal axis of said support shaft and said braking means move radially towards said support shaft axis.

8. An open-end spinning device as set forth in claim 1, wherein said braking means has a braking surface of a variable radius and the braking surface to which braking force is applied has a corresponding variable radius which mates with said braking surface.

9. An open-end spinning device as set forth in claim 1, wherein said rotor has a braking surface thereon for interacting with said braking means.

10. An open-end spinning device as set forth in claim 1, wherein the braking surface of said braking means comprises a profile which mates with the profile of the surface to be braked so as to maintain the axial position of said rotor.

11. An open-end spinning device as set forth in claim 1, wherein said braking means comprises a plurality of brake shoes disposed in a circumferential path about the surface to be braked and are applied to said surface radially.

12. An open-end spinning device as set forth in claim 1, wherein said braking means comprises a plurality of brake shoes and pneumatic means for applying said brake shoes to the brakes surface.

13. An open-end spinning device as set forth in claim 1, wherein said braking means comprises a plurality of brake shoes supported by a ring channel comprising of a deformable material.

14. An open-end spinning device as set forth in claim 13, wherein said ring channel comprises a brake collar and a support ring.

15. An open-end spinning device as set forth in claim 14, wherein said brake shoes are firmly connected to said brake collar and are supported and guided by said collar.

16. An open-end spinning device as set forth in claim 15, wherein said braking means comprises three brake shoes arranged radially at equal distances between each other on said brake collar.

17. An open-end spinning device as set forth in claim 12, wherein said braking means comprises a pneumatic braking collar with at least one vent for directing a flow of compressed air onto said braking surface.

18. An open-end spinning device, comprising:

(a) a pneumatically sealed open-end spinning rotor housing;

(b) a support shaft extending through one wall of said spinning rotor housing;

(c) an open-end spinning rotor disposed within said spinning rotor housing and supported by one end of said support shaft;

(d) spaced bearing means disposed outside of said housing for supporting said support shaft for rotation;

(e) drive means for driving said support shaft; and (f) braking means disposed within said rotor housing including a plurality of brake shoes disposed concentrically about a braking surface within said rotor housing for stopping the rotation of said support shaft and said rotor.

19. An open-end spinning device as set forth in claim 18, wherein said brake shoes are pneumatically urged toward said braking surface.

20. An open-end spinning device as set forth in claim 18, wherein said brake shoes are urged against said braking surface by electromagnetic means.

* * * * *

UNITED STATES PATENT AND TRADEMARK OFFICE

CERTIFICATE OF CORRECTION

PATENT NO. : 4,932,199

DATED : June 12, 1990

INVENTOR(S) : Eberhard Grimm

It is certified that error appears in the above-identified patent and that said Letters Patent is hereby corrected as shown below:

On the title page:

(30) Foreign Application Priority Data

Aug. 2, 1988 (DE) Fed. Rep. of Germany ... 3826177

Signed and Sealed this

Seventh Day of July, 1992

*Attest:*

DOUGLAS B. COMER

*Attesting Officer*

*Acting Commissioner of Patents and Trademarks*